US009275558B1

(12) United States Patent
Travers

(10) Patent No.: US 9,275,558 B1
(45) Date of Patent: Mar. 1, 2016

(54) MULTI-MODE CARD ATTACHMENT DEVICE FOR A GIFT

(71) Applicant: Caroline B. Travers, Virginia Beach, VA (US)

(72) Inventor: Caroline B. Travers, Virginia Beach, VA (US)

( * ) Notice: Subject to any disclaimer, the term of this patent is extended or adjusted under 35 U.S.C. 154(b) by 0 days.

(21) Appl. No.: 14/512,569

(22) Filed: Oct. 13, 2014

(51) Int. Cl.
*G09F 1/10* (2006.01)
*B42D 15/02* (2006.01)

(52) U.S. Cl.
CPC . *G09F 1/10* (2013.01); *B42D 15/02* (2013.01)

(58) Field of Classification Search
CPC ..... B42D 15/02; B42D 5/027; B42D 15/045; G09F 1/10; B26D 3/085
USPC ..... 40/124.01
See application file for complete search history.

(56) References Cited

U.S. PATENT DOCUMENTS 3,085,551 A * 4/1963 Helmer ..... A01K 15/024 119/706
3,916,838 A * 11/1975 Swart ..... A01K 15/024 119/712
4,216,598 A * 8/1980 Newbert ..... G09F 3/04 40/331
4,460,119 A * 7/1984 Goodfellow ..... B65D 27/00 206/806
4,545,521 A * 10/1985 Hiersteiner ..... B65D 27/00 229/68.1
D350,371 S * 9/1994 Rayle ..... D11/118
5,458,282 A * 10/1995 Martin ..... B42D 15/0053 229/92.8
6,092,842 A * 7/2000 Arway ..... B42D 15/006 283/79
6,290,261 B1 * 9/2001 Waggoner ..... B42D 15/006 281/2
6,497,063 B1 * 12/2002 Stephens ..... G09F 3/10 40/6
7,249,432 B2 7/2007 Lewis
D617,387 S * 6/2010 Muniz ..... D20/42
8,176,663 B2 5/2012 Sapp et al.
2006/0062494 A1 3/2006 Aptekar
2012/0311899 A1 * 12/2012 Mathewson ..... G09F 23/00 40/310
2014/0059811 A1 3/2014 Accola

* cited by examiner

*Primary Examiner* — Shin Kim
(74) *Attorney, Agent, or Firm* — William G. Sykes

(57) ABSTRACT

A card attachment device for attaching a greeting card to a package having a thin, elongated substrate folded into a front and rear portion. The substrate has a through hole with a slot connecting the through hole to an edge of respective front and rear portions of the substrate. Adhesive is disposed on at least a portion of an inward facing surface of both said front and rear portions. A greeting card may be secured between adhesive on the front and rear portions. The secured card may be secured to an elongated handle of a gift bag. The card attachment device has a perforation allowing portions to be separated from one another and used in combination to secure a greeting card to a package without elongated handles.

9 Claims, 5 Drawing Sheets

MULTI-MODE CARD ATTACHMENT DEVICE FOR A GIFT

FIELD OF THE INVENTION

The invention pertains to devices for attaching a card to a package and, more particularly, to an attachment device selectively using either physical and/or adhesive properties for attaching a card to a gift bag or another style package.

BACKGROUND OF THE INVENTION

Gift bags provide a convenient way to prepare a present for presentation to an intended recipient. Gift bags may readily be purchased at a variety of outlets. For example, they are typically available in establishments that sell greeting cards (e.g., drug stores, grocery stores, department stores, etc.). Gift bags provide a way to present gifts, especially gifts having an unusual shape. Gift bags eliminate the tedium of conventional gift wrapping and require no special facilities or supplies (e.g., a flat surface, scissors, tape, etc.). Gift bags are especially appreciated by those who are "gift wrapping challenged".

One major drawback to conventional gift bags is the relative difficulty encountered in attaching a conventional greeting card to the gift bag. Many gift bags have a body having two opposing longer walls which are provided with a pair of strap holes near a top opening of the bag. A pair of string or rope members is attached to the holes to facilitate carrying the gift bag.

Some people using gift bags to present gifts prefer to include a greeting card along with the gift in the gift bag. Typically, the greeting card is simply put inside the gift bag, and the recipient may not notice the card immediately especially if decorative tissue paper is added to the bag.

Some gift bags are provided with a small, pre-attached gift card, often referred to as hang tags. Such cards may not properly express the sentiment of the gift giver and, generally are not private. Even if the bags came with hang tags attached to their straps, they offer little opportunity to keep a greeting private.

It would, therefore, be advantageous to provide a simple device for securely attaching a card in an envelope to a package such as a gift bag without use of tape or other such supplies.

DISCUSSION OF THE RELATED ART

Several attempts are seen in the prior art to overcome the deficiencies discussed hereinabove. For example, United States Published Patent Application No. 2006/0062494 for BAG WITH CARD HOLDER published Mar. 23, 2006 upon application by Larry Aptekar provides a bag including an upright bag body having a rectangular mouth portion confined by opposite longer walls and opposite shorter walls that interconnect the longer walls. At least one of the longer walls is formed with a set of first strap holes there through. A carrying strap has opposite sections that extend respectively through the first strap holes and that are formed with a respective knotted end for connecting the carrying strap to the bag body. A card holder with a means of connecting to the straps includes an upright plate and a folded lower part that confines an upwardly opening card receiving space adapted for holding a portion of a greeting card therein.

U.S. Pat. No. 7,249,432 for VEHICLE LOCATOR AND IDENTIFICATION CARD issued Jul. 31, 2007 to Mark W. Lewis teaches a vehicle identification and locator card for vehicle parking and servicing establishments includes an upper portion made of paper board and a lower portion made of synthetic paper. An ignition key tag is die cut from the lower synthetic paper portion, which retains its strength when wet. The lower portion has a backing of a dry release laminate patch. The lower portion may be attached to the upper portion by an adhesive tape or it made be attached by having a part of the dry release laminate patch extend beyond the lower portion and beneath the upper portion.

U.S. Pat. No. 8,176,663 for ELECTRONIC GREETING CARDS AND NOVELTIES WITH MOVEABLE ELEMENTS AND MANUAL ELECTRONIC CIRCUIT ACTIVATION issued May 15, 2012 to David Snapp et al. teaches greeting cards and novelties with electronic circuits having switch mechanisms operable by manipulation of a moveable component. Manipulation of the moveable component causes activation of the electronic circuits. The electronic greeting card with audio capabilities may be associated with a gift bag (column 6, lines 17-39, and FIGS. 13 and 14).

United States Published Patent Application No. 2014/0059811 for FLEXIBLE DEVICE FOR ATTACHING CARDS TO A GIFT OR PACKAGE published Mar. 6, 2014 upon application by Katharine Accola teaches a decorative clip that firmly holds a greeting card with ease of removal and replacement. The clip is attached to a ribbon or elongated band by a connector that provides angular, vertical and lateral positioning of the top of the clip with respect to the package to adapt to the shape and size of the package. The present invention also includes a kit of components that can be sold as a unit as well as a method of assembling the components in three ways to provide the optimum versatility of the packaging to fit the size and shape of the package. One such kit is specifically disclosed for wrapping one of the most common gifts of a bottle of wine.

None of the patents and published patent applications, taken singly, or in any combination are seen to teach or suggest the card attachment device of the present invention.

SUMMARY OF THE INVENTION

In accordance with the present invention there is provided a card attachment device that allows readily removably attaching a greeting card to a package. In a first mode of uses, a card is attached to the rope or string handle of a gift bag or the like. In a second mode of operation, a portion of the card attaching device may be separated from another portion of the card attaching device and used to adhesively attach a greeting card to a package without a string or rope handle. The device uses low tack adhesive allowing easy removal of the card and potential reuse of the card attaching device.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENT

The present invention provides a device for attaching a card (e.g., a greeting card) to a package, particularly to a gift. The novel device of the invention is particularly useful for removably attaching a card to a so-called gift bag. The novel attachment may be used in two alternate configurations. In a first configuration, the card is attached to gift bag handle, a ribbon, or any other thin, elongated member associated with the package to which the card is to be attached. In a second configuration, the device may be used to removably attach a card to a surface of a gift with a low tack adhesive using portions of the gift attachment device or another adhesive member provided with the card attachment device.

Figure 2:
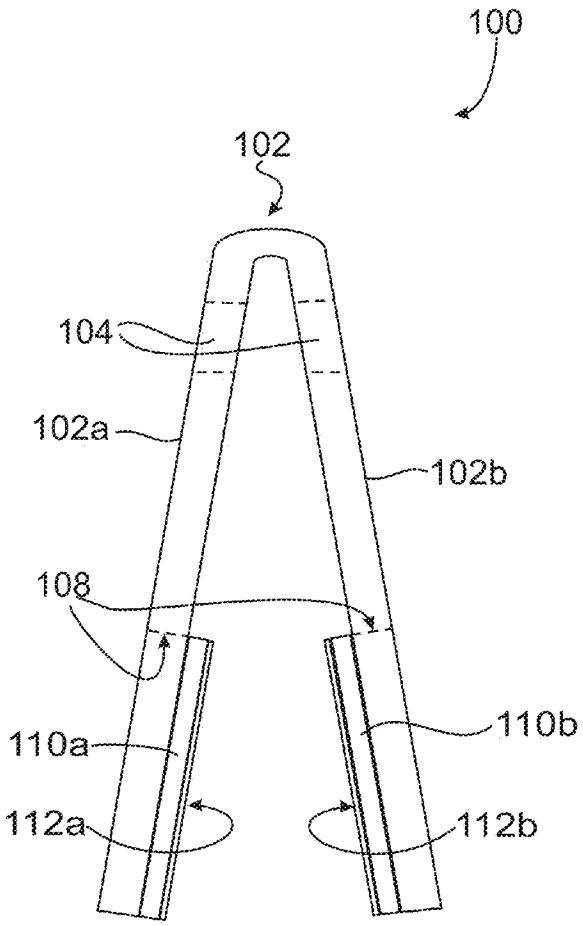
FIG. 2 is a side elevational, schematic view of the card attachment device of FIG. 1.
Figure 1:
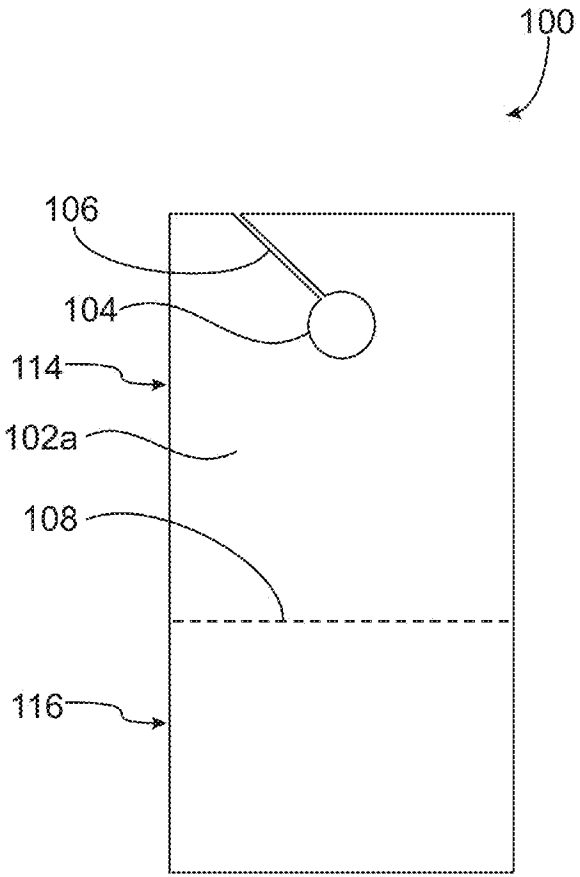
FIG. 1 is a front elevational, schematic view of a first embodiment of a card attachment device in accordance with the invention.

Referring first to FIGS. 1 and 2, there are shown front and side elevational, schematic views, respectively, of a first embodiment of the card attaching device in accordance with the invention, generally at reference number 100.

A thin substrate 102 is folded at a centerline, not specifically identified, to define a front substrate member 102*a* and a corresponding rear substrate member 102*b*. Substrate 102 is typically formed from a thin polymeric material, typically polyethylene, polypropylene, or the like and having a thickness in the range of between 1/64 and 5/64 inches. The material may be transparent, translucent, or colored. Card attachment devices in accordance with the invention may be provided in a variety of colors. It will be recognized by those of skill in the art that card stock or other paper material may be substituted for the polymeric material chosen for purposes of disclosure.

A hole 104 is disposed through both front and rear substrate members 102*a*, 102*b*.

A slot 106 connects an edge of hole 104 to an upper edge of both front and rear substrate members 102*a*, 102*b*.

A perforation 108 is disposed across both front and rear substrate members 102*a*, 102*b*. Perforation 108 allows separating an upper region 114 of both front and rear substrate members 102*a*, 102*b* from respective lower regions 116 thereof.

Adhesive 110*a*, 110*b* covers at least some of respective lower regions 116 of front and rear substrate portions 102*a*, 102*b*, respectively. Typically adhesive 110*a*, 110*b* is a low tack adhesive material.

Protective membrane layers 112*a*, 112*b* cover respective adhesive areas 110*a*, 110*b*, respectively.

Figure 3:
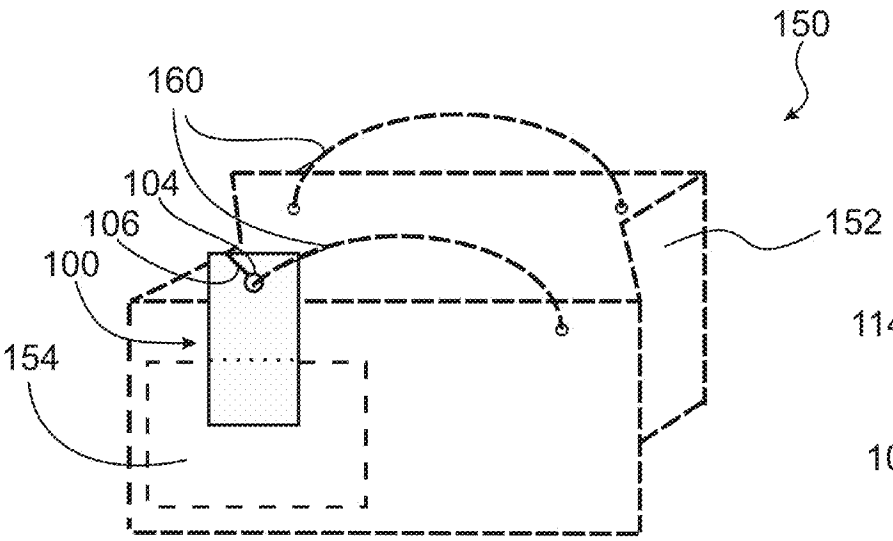
FIG. 3 is a front perspective, schematic view of a gift bag having a card attached using the attachment device of FIGS. 1 and 2.

Referring now also to FIG. 3 there is shown a perspective, schematic view of a gift bag 152 with card attachment device 100 attaching a card 154 to the gift bag 152, generally at reference number 150. Gift bag 152 has one or more "rope" handles 160. Neither gift bag 152 nor card 154 form any part of the invention and are both shown to better illustrate the novel card attachment device 100 of the invention in its intended operating environment.

The term "rope" as used herein is intended to refer to any rope-like, elongated material from which handle(s) 160 may be fashioned. Consequently, the invention is intended to include any and all materials, regardless of cross-sectional shape or method of attachment to gift bag 152.

In operation, protective membrane layers 112*a*, 112*b* are first removed from respective adhesive areas 110*a*, 110*b*.

A card 154, typically enclosed in an envelope, not specifically identified, is placed between adhesive layers 110*a*, 110*b* and then front and back substrate members 102*a*, 102*b* are pressed inwardly toward one another thereby securing the envelope or card therebetween by means of adhesive regions 110*a*, 110*b*.

The slot 106 of gift attaching device 100 is then slid over one of rope handles 160 or similar elongated structure until rope handle 160 is retained in hole 104. Other known objects to which card attaching device 100 may be attached via slot 106 and hole 104 include, but are not limited to ribbon, string, and twine that are attached to a gift package.

A second embodiment of the novel gift card attaching device of the invention is formed from the first embodiment of the novel gift attaching device of FIGS. 1, 2, and 3. The second embodiment is useful for attaching a card (e.g., card 154) to a package not equipped with a handle, ribbon, string, twine, etc. It should be noted that adhesive layers 110*a*, 110*b* are preferably so-called "low tack" adhesive. Low tack adhesives are believed to be well known to those of skill in the art and, consequently, are not further discussed herein.

Figure 4:
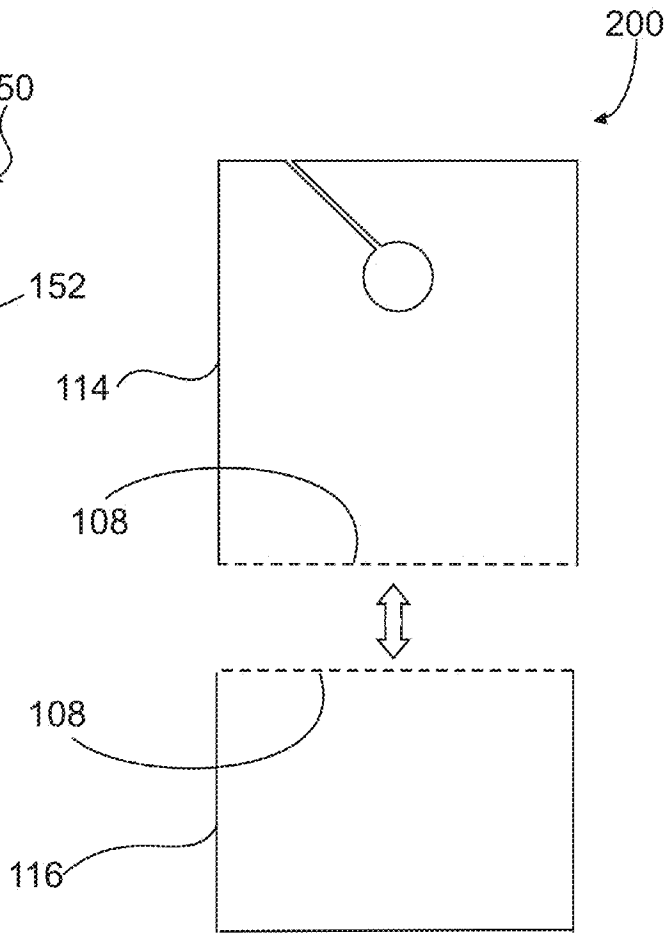
FIG. 4 is a front plan, schematic view of the card attachment device of FIG. 1 with a top portion separated from a bottom portion.

Referring now also to FIG. 4, there is shown a front elevational, schematic view of this second embodiment, generally at reference number 200. To form the second embodiment 200 of the novel card attachment device, upper portion 114 of card attachment device 100 is separated from lower portion 116 along perforation line 108. Upper portion 114 may be discarded.

Figure 5:
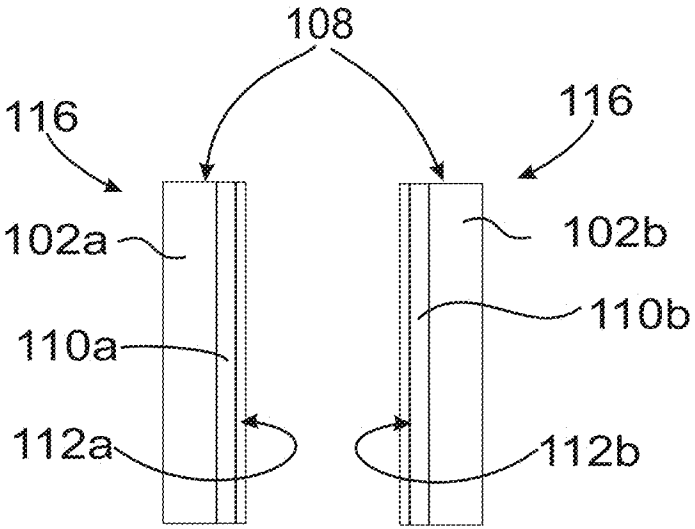
FIG. 5 is a side elevational, schematic view of the bottom portion of the card attachment device of FIG. 4 after separation from the top portion.
Figure 8:
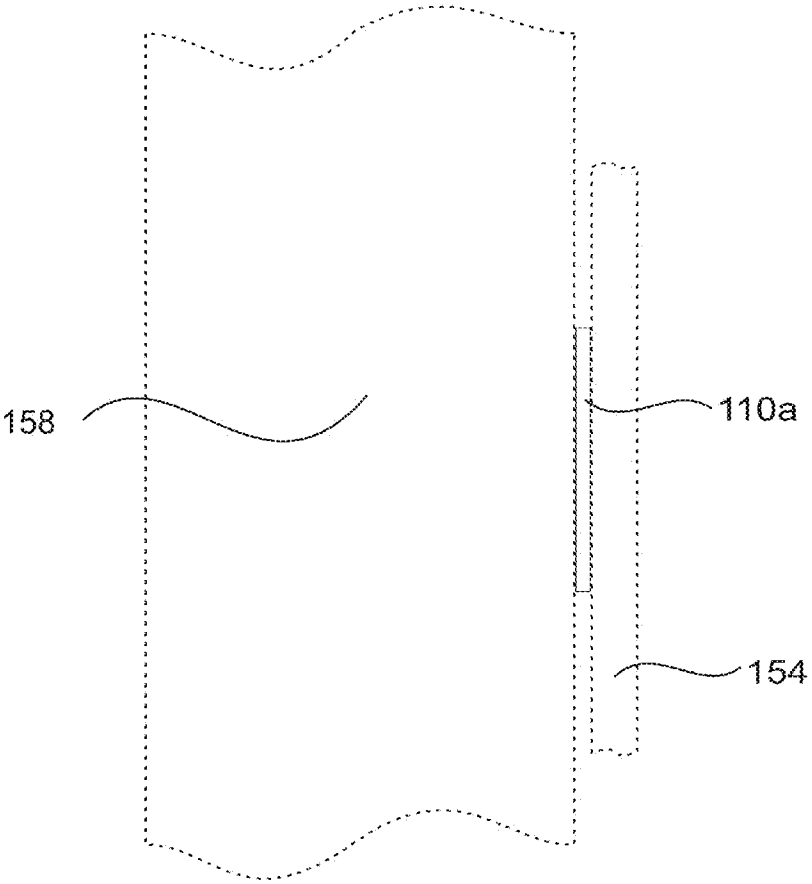
FIG. 8 is a side elevational, schematic view of the a card now attached to a package.

Referring now also to FIG. 5, the remaining lower regions 116 of front and rear substrate portions 102*a*, 102*b* with adhesive regions 110*a*, 110*b* and protective membrane layers 112*a*, 112*b*, respectively, are shown is a side elevational, schematic view.

Figure 9:
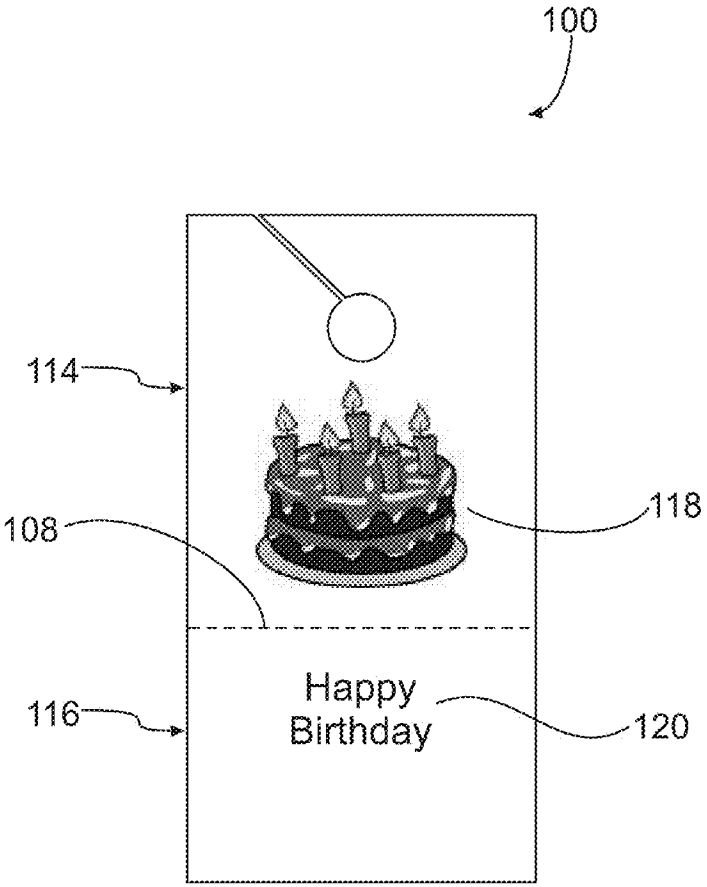
FIG. 9 is a front elevational, schematic view of the card attachment device of FIG. 1 shown with typical indicia thereupon.

The remaining two separate lower portions 116 may be used to attach a card, for example card 154 to a package 158 that has no elongated member such as rope handles 160 useful in using the first embodiment 100 of the novel card attachment device. Package 158 is best seen in FIG. 9.

Figure 6:
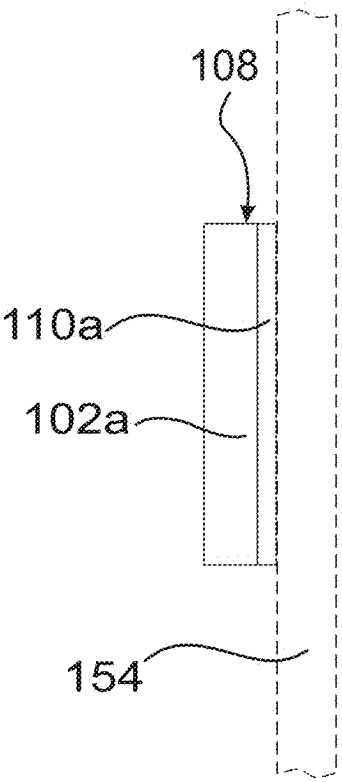
FIG. 6 is a side elevational, schematic view of the front side of the bottom portion of FIG. 5 attached to a card.

This is accomplished by first removing protective membrane 112*a* exposing adhesive layer 110*a*. Adhesive layer 110*a* may then be attached to a surface of card 154 as shown in FIG. 6.

Figure 7:
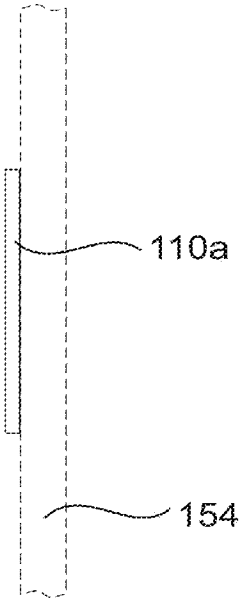
FIG. 7 is a side elevational view of a rear side of the bottom portion of FIG. 6 with a substrate portion removed.

Once card 154 is attached to substrate 102*a* with adhesive layer 110*a*, substrate 102*a* may then be peeled away from adhesive layer 110*a* now attached to card 154 as shown in FIG. 7.

The newly exposed surface of adhesive 110*a* may then be attached to a package 158, thereby attaching card 154 to package 158.

Referring now also to FIG. 9, there is shown a front, elevational view of the card attachment device of FIG. 1 bearing representative indicia on a front surface thereof. It will be recognized that indicia may be placed on one or both front and rear surfaces.

Typical indicia may consist of a holiday greeting, for example: Happy Birthday, Merry Christmas, Happy Hanukah, etc. The text "Happy Birthday" 120 is shown in FIG. 9.

Indicia may also or alternatively consist of pictures or symbols such as one or more hearts to represent Valentine's Day, or a combination of text and symbols. Other examples include a cake 118 or an ice cream cone, not shown, combined with the text "Happy Birthday" 120.

Indicia may be stock or custom designed and printed for a special occasion. Any known method of application may be used for adding indicia to the card attaching device 100 of the invention and the invention is not considered limited to any specific indicia content or to any application method.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A device for attaching a card to a package, comprising:

a) a thin, elongated rectangular substrate having a major axis and a centerline disposed at and perpendicular to a centerline of said major axis, said thin elongated rectangular substrate being folded at said centerline to define a front substrate portion and an opposing rear substrate portion;

b) a through hole disposed in each of said front substrate portion and said rear substrate portion, said through holes being disposed proximate said centerline;

c) a slot disposed in each of said front substrate portion and said rear substrate portion, said slot connecting each of said through holes to a respective upper edge of each of said front substrate portion and said rear substrate portion;

d) a perforation disposed in each of said front substrate portion and said rear substrate portion perpendicular to said centerline, said perforation defining a top portion and a bottom portion in each of said front substrate portion and said rear substrate portion;

e) adhesive disposed on at least a portion of an inside surface of each of said front substrate portions and said rear substrate portions; and f) a protective barrier disposed on said adhesive on each of said front substrate portion and said rear substrate portion.

2. The device for attaching a card to a package as recited in claim 1, wherein said thin elongated rectangular substrate is formed from a polymer material.

3. The device for attaching a card to a package as recited in claim 2, wherein said thin elongated rectangular substrate has a thickness in the range of approximately 1/64 and 5/64 inches.

4. The device for attaching a card to a package as recited in claim 1, wherein said thin elongated rectangular substrate is formed from a paper-based material.

5. The device for attaching a card to a package as recited in claim 1, wherein said adhesive comprises a low tack adhesive.

6. The device for attaching a card to a package as recited in claim 1, wherein said thin elongated substrate has a visual characteristic chosen from the group: clear and transparent, opaque, colored and transparent, colored and opaque.

7. The device for attaching a card to a package as recited in claim 6, further comprising:

g) indicia disposed on at least a portion of at least one of said front substrate portion and said rear substrate portion.

8. A method for attaching a greeting card to a package having an elongated handle, the steps comprising:

a) providing a card attachment device comprising a thin, elongated rectangular substrate having a major axis and a centerline disposed at and perpendicular to a centerline of said major axis, said thin elongated rectangular substrate being folded at said centerline to define a front substrate portion and an opposing rear substrate portion, both front and rear portions having a through hole disposed therein and a slot disposed in each of said front substrate portion and said rear substrate portion, said slot connecting each of said through holes to a respective upper edge of each substrate portion, adhesive disposed on at least a portion of an inside surface of a lower portion of each substrate portion and a protective barrier disposed on said adhesive on each of said substrate portions;

b) removing said protective barrier from said adhesive on each substrate portion;

c) placing a greeting card between each uncovered adhesive portion and adhering said greeting card to said adhesive on each substrate portion; and d) using said slot to insert said elongated handle into said through hole in each of said substrate proton.

9. A method for attaching a greeting card to a package without an elongated handle, the steps comprising:

a) providing a card attachment device comprising a thin, elongated rectangular substrate having a major axis and a centerline disposed at and perpendicular to a centerline of said major axis, said thin elongated rectangular substrate being folded at said centerline to define a front substrate portion and an opposing rear substrate portion, both front and rear portions having a through hole disposed and having a slot disposed in each of said front substrate portion and said rear substrate portion, said slot connecting each of said through holes to a respective upper edge of each substrate portion, a perforation in each of said substrate portions defining an upper region and a lower region thereof, adhesive disposed on at least a portion of an inside surface of said lower region of each substrate portion and a protective barrier disposed on said adhesive on each of said substrate portions;

b) separating said upper region from said lower region of each substrate portion and discarding said upper portions;

c) removing said protective barrier from said adhesive on one of two remaining lower portions of said substrate portions and adhering said exposed adhesive to a greeting card;

d) removing said protective barrier from said adhesive on a second one of two remaining lower portions of said substrate portions and adhering said exposed adhesive to said substrate of said lower region of said first substrate portion; and e) removing said substrate from said lower region of said second substrate portion and adhering said exposed adhesive to a package surface.

* * * * *